United States Patent [19]

Schellenberg

[11] 3,971,291

[45] July 27, 1976

[54] APPARATUS FOR COCKING A BREECHBLOCK

[75] Inventor: Heinz Schellenberg, Wetzikon, Switzerland

[73] Assignee: Werkzeugmaschinenfabrik Oerlikon-Bührle AG, Zurich, Switzerland

[22] Filed: Oct. 15, 1974

[21] Appl. No.: 514,833

[30] Foreign Application Priority Data

Nov. 1, 1973 Switzerland ..... 15396/73

[52] U.S. Cl. ..... 89/1 K; 192/141; 192/150

[51] Int. Cl.[2] ..... F41D 11/00

[58] Field of Search ..... 89/1 K; 192/141, 150

[56] References Cited

UNITED STATES PATENTS

| | | | |
|---|---|---|---|
| 2,397,507 | 4/1946 | Roberts | 89/1 K |
| 2,413,241 | 12/1946 | Mejean et al. | 89/1 K |
| 2,856,046 | 10/1958 | Bofinger | 192/150 |
| 3,110,206 | 11/1963 | Hake | 192/150 |
| 3,583,253 | 6/1971 | Grimshaw et al. | 192/150 |

*Primary Examiner*—Stephen C. Bentley
*Attorney, Agent, or Firm*—Werner W. Kleeman

[57] ABSTRACT

An apparatus for cocking a breechblock of an automatic firing weapon equipped with an electric motor which is operatively connected through the agency of an electromagnetic coupling with a displacement mechanism for the breechblock in order to move the breechblock into its cocked position, an electric switch which, upon reaching the cocked position, cuts-off the coupling. An overload device is provided which upon exceeding a certain value of the displacement resistance of the breechblock actuates the electric switch for cutting-out the coupling.

2 Claims, 7 Drawing Figures

APPARATUS FOR COCKING A BREECHBLOCK

BACKGROUND OF THE INVENTION

The present invention relates to a new and improved apparatus for cocking the breechblock of an automatic firing weapon equipped with an electric motor which is connected through the agency of an electromagnetic coupling with a displacement mechanism for the breechblock in order to move the breechblock into its cocked position, and further includes an electric switch which, upon reaching the cocked position, disconnects or cuts-off the coupling.

According to a known apparatus of this type the electric switch can be actuated by the breechblock as soon as such has reached its cocked position. This switch is actuated upon firing each shot. Especially during series or rapid firing the breechblock impacts against the switch with great velocity, so that such is destroyed relatively quickly. Furthermore, this known switch is not capable of disconnecting the electromagnetic coupling in the event that owing to some disturbance the breechblock has not been displaced into its cocked position.

SUMMARY OF THE INVENTION

The present invention aims at avoiding both of these drawbacks and providing an apparatus wherein, upon the presence of disturbances which render difficult displacement of the breechblock, the electromagnetic coupling is disconnected and in which apparatus the electric switch is only actuated upon cocking of the breechblock.

Now in order to implement this object and others which will become more readily apparent as the description proceeds, the invention contemplates the provision of an apparatus having an overload device which upon exceeding a predetermined value of the displacement resistance of the breechblock actuates the electric switch for disconnecting the coupling.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
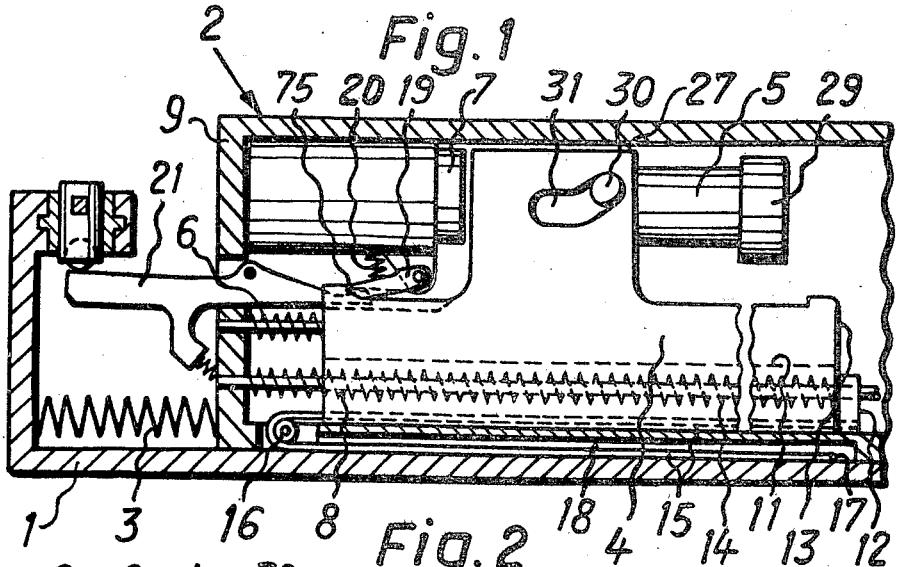
FIG. 1 is a longitudinal sectional view through the rear portion of an automatic firing weapon or gun with the breechblock in the hooked or engaged position.

Describing now the drawing, according to the showing of FIG. 1 there is displaceably mounted in the balance or rocker 1 of a not particularly illustrated gun mount the breechblock housing 2 of an automatic firing weapon. Between the breechblock housing 2 and the rocker or balance 1 there is provided a dampening mechanism or shock-absorber which has been shown simplified in FIG. 1 in the form of a spring 3. Internally of the breechblock housing 2 there is displaceably mounted a breechblock. The breechblock is essentially composed of a support or carrier 4 and a cylindrical head 5. A closing spring 6 for the breechblock 4, 5 bears at one end at the breechblock housing 2 and at the other end at the breechblock support or carrier 4. Furthermore, a buffer or shock-absorber 7 is attached to the breechblock housing 2. A rod 8 is secured in a rear wall 9 and a front wall 10 of the breechblock housing 2. The rod 8 which is directed parallel to the direction of movement of the breechblock 4, 5 is piercingly guided through a groove 11 of the breechblock carrier or support 4.

An entrainment member 12 is displaceably mounted at the rod 8 and bears at the front end surface 13 of the breechblock support or carrier 4. A spring 14 is pushed over the rod 8 and bears at one end at the wall 9 of the breechblock housing 2 and at the other end at the entrainment member 12. A chain 15 is guided about a sprocket wheel or gear 16. The entrainment member 12 is connected with one end of the chain 15 and the other end 17 of the chain 15 is movably mounted in a groove 18 of the breechblock housing 2. A catch hook 19 is hingedly connected at the housing of the shock-absorber 7. This catch hook 19 is subjected to the pressure of a spring 20 and can be moved away from the catch position by an actuation lever 21.

Figure 2:
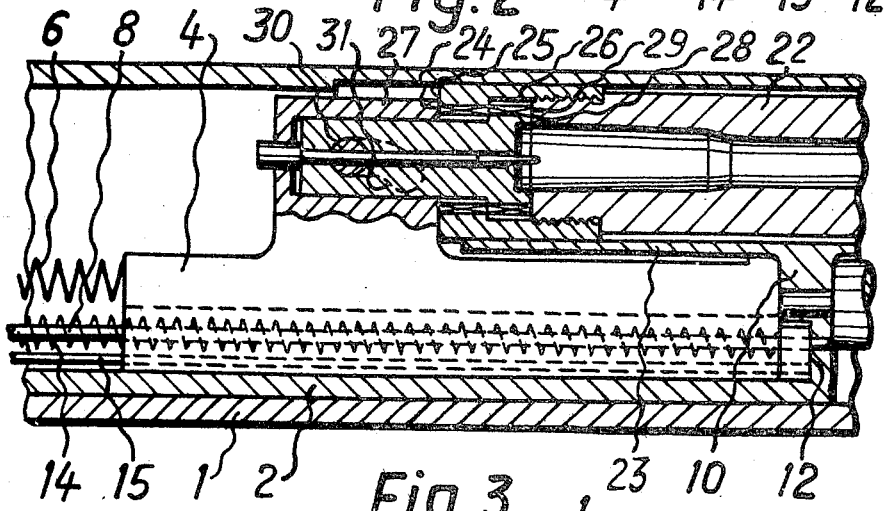
FIG. 2 is a longitudinal sectional view through the front portion of the automatic firing weapon of FIG. 1 with the breechblock in the forward terminal position.

According to the showing of FIG. 2 a weapon barrel 22 is displaceably secured in a sleeve-shaped portion 23 of the breechblock housing 2. The rear end of the weapon barrel 22 possesses a flange 25 equipped with internal teeth 24. In front of this flange 25 the weapon barrel 22 internally possesses a peripheral groove 26. The breechblock support or carrier 4 is arranged at the rear of the weapon barrel 22. The breechblock body 5 is rotatably mounted in a sleeve 27 connected with the breechblock support or carrier 4. The breechblock body 5 possesses at its front end a flange 28 which is equipped with external teeth 29. The gaps between the teeth 24 of the flange 25 are designed such that the teeth 29 of the flange 28 of the breechblock body 5 piercingly extend through such gaps.

As soon as the flange 28 is located in the groove 26 of the weapon barrel 22 then the breechblock body 5 can rotate through one half tooth division. The teeth 29 of the breechblock body 5 are then located in front of the teeth 24 of the weapon barrel 22, so that the breechblock body 5 is locked at the weapon barrel 22. For rotating the breechblock body 5 in the breechblock support sleeve 27 a control bolt 30 is attached at the breechblock body 5. This control bolt 30 extends with both ends into screw-like or helical-shaped control grooves 31 of the breechblock support sleeve 27. A displacement of the breechblock body 5 in the breechblock support sleeve 27 at the same time brings about a rotation of the breechblock body 5.

Figure 3:
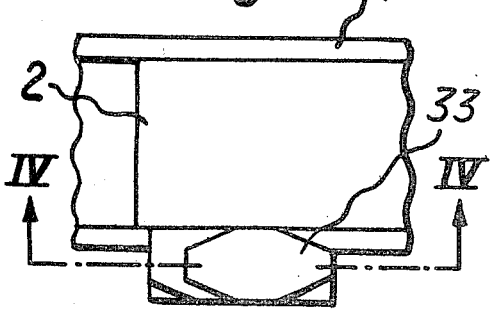
FIG. 3 is a plan view of the rear portion of the firing weapon.
Figure 4:
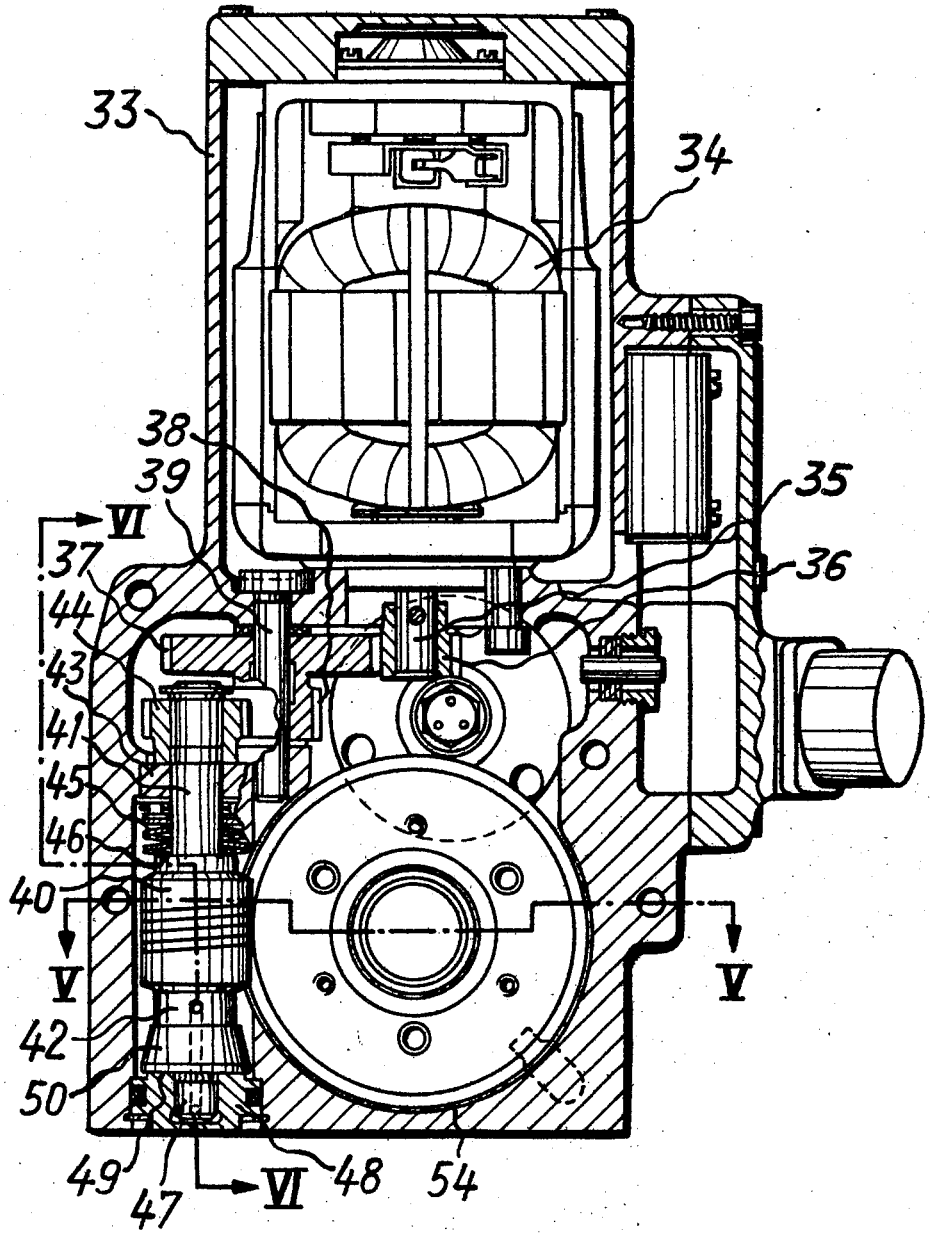
FIG. 4 is a sectional view taken along the line IV—IV of FIG. 3.

A housing 33 is attached to the breechblock housing 2 (FIG. 3). According to the showing of FIG. 4 an electric motor 34 is arranged at the upper portion of the housing 33. A spur gear 36 is keyed to the shaft 35 of the electric motor 34. The gear 36 meshes with one of two toothed crowns or rims 37, 38 of a wheel, namely, the toothed crown or rim 37, and which wheel is rotatably mounted at a shaft 39 connected with the housing 33. A worm 40 possesses two shaft projections or extensions 41, 42. The shaft projection 41 is rotatably and lengthwise displaceably mounted in a wall 43 of the housing 33. A spur gear 44 is keyed with the shaft projection 41 and meshes with the toothed rim 38 of the gear or wheel seated on the shaft 39. A package of plate springs 45 is supported at one end at a shoulder 46 of the shaft projection 41 and at the other end at the housing wall 43. The plug-like end 47 of the shaft projection 42 is mounted to be lengthwise displaceable in a bore of the housing wall 48. The shaft projection 42 bears with one shoulder 49 under the pressure of the plate springs 45 at the housing wall 48. A portion 50 of the shaft projection 42 is of truncated conical shape, and the base surface of this portion 50 forms the shoulder 49.

Figure 5:
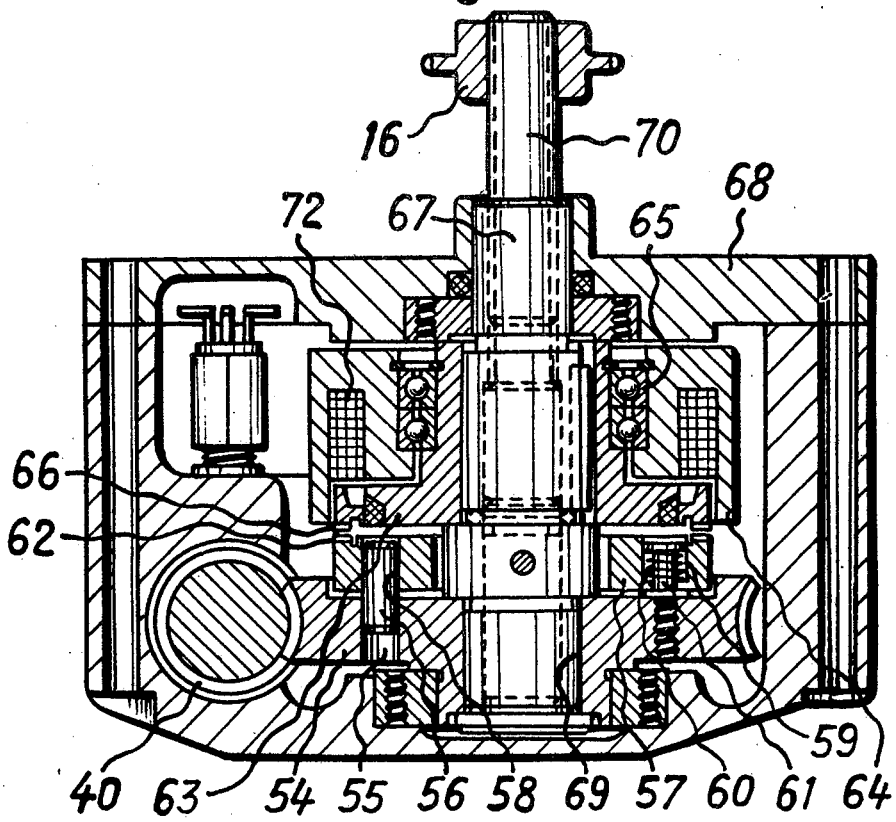
FIG. 5 is a sectional view along the line V—V of FIG. 4.
Figure 6:
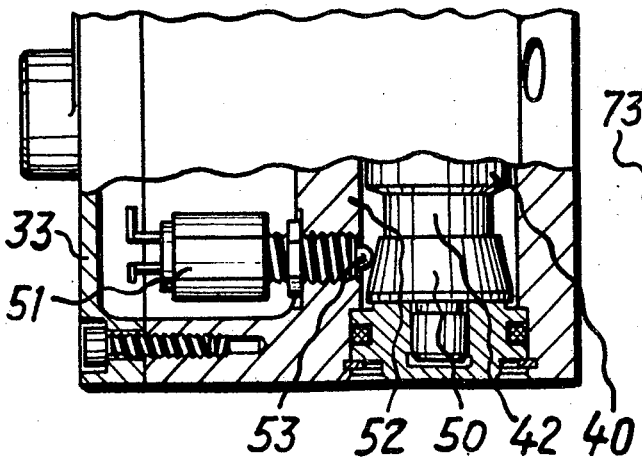
FIG. 6 is a partial sectional view along the line VI—VI of FIG. 4.

An electric switch 51, according to the showing of FIG. 6, is secured in an intermediate wall 52 of the housing 33. A pusher member 53 of the switch 51 bears against the portion 50 of the shaft projection 42. According to the showing of FIG. 5 the worm 40 meshes with a worm gear 54 which is rotatably mounted in the housing 33. The worm gear 54 possesses bores 55 which are parallel to its axis of rotation. Bolts 56 are seated in the bores 55. The bolts 56 extend into the bores 58 of an armature ring 57 of an electromagnetic coupling which is arranged co-axially with respect to the worm gear 54. The armature ring 57 possesses bores 59 in which there are arranged springs 60. Springs 60 bear on the one hand at the ring 57 and on the other hand at the heads of bolts 61 which are screwed into the worm gear 54. Under the pressure of the springs 60 the armature ring 57 bears against the worm gear 54. The armature ring 57 possesses a toothed rim or crown 62 which protrudes from its end surface. Both parts 63, 64 of a magnetic body are rotatably mounted with respect to one another by the roller bearing 65. The magnetic body portion 64 contains a magnetic coil 72 and the portion or part 63 likewise possesses a toothed rim 66 which forms the counter element or teeth for the crown or rim 62 of the armature ring 57. The magnetic body portion 63 is keyed with a shaft 67 which is rotatably mounted in the housing wall 68 and in a bore 69 of the worm gear 54. The sprocket gear 16 is seated upon a notched toothed shaft 70 which is in driving connection with the shaft 67.

Figure 7:
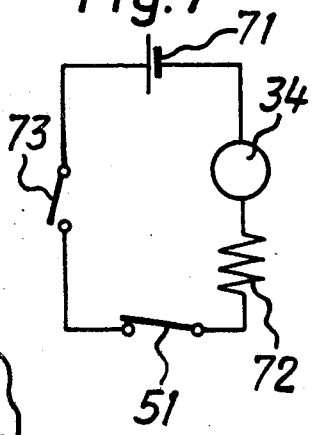
FIG. 7 is an electric circuit diagram.

Continuing, in FIG. 7 reference numeral 71 designates an electric voltage source. The motor 34, the magnetic coil 72 and two switches 51 and 73 are connected in series in a conductor or line 74 which connects both poles or terminals of the voltage source 71.

The mode of operation of the described apparatus is as follows:

It is assumed that the breechblock 4, 5 is located in its forwardmost position according to the showing of FIG. 2 in which the breechblock body 5 is locked with the weapon barrel 22. The control bolt 30 is located at the rear end of the control grooves 31. The previously open switch 73 is closed. Now since a current flows in the magnetic coil 72 the armature ring 57 guided by the bolts 56 is attracted by the magnetic body 63, with the result that both toothed rims or crowns 62, 66 come into meshing engagement with one another. At the same time the electric motor 34 begins to run, so that via the gears 36, 37, 38 and 44 the worm 40 and thus also the worm gear 54 are driven. The worm gear 54 drives the armature ring 57 and such in turn the magnetic body portion 63, whereas the magnetic body portion 64 which carries the magnetic coil 72 stands still. By means of the magnetic body portion 63 the shaft 67, and by virtue of the latter, the sprocket gear 16 with the chain 15 is driven. The breechblock support or carrier 4 is displaced towards the rear by the entrainment member 12 which is connected with the chain 15, so that it carries out a relative movement with respect to the breechblock body 5. The control bolt 30 displaces in the control grooves 31, with the result that the breechblock body 5 is rotated in the breechblock carrier sleeve 27 and the blocking or locking action between the breechblock body 5 and the weapon barrel 22 is eliminated, so that also the breechblock body 5 can move back. When the breechblock 4, 5 with the catch notch 75 has passed the catch hook 19 and impacted against the shock-absorber 7, then there is exerted a forwardly directed force upon the breechblock carrier or support 4. This force is transmitted via the chain 15 through the sprocket gear 16, the shaft 67, the magnetic body portion 63, the armature ring 57 and the worm gear 54 in clockwise direction (viewed in the showing of FIG. 4) to the worm 40, so that such is moved in axial direction against the pressure of the springs 45. Consequently, the portion 50 of the shaft projection 42 slides along the pusher or pusher element 53 (FIG. 6) of the electric switch 51 so that such is opened and the current circuit to the electric motor 34 and the magnetic coil 72 is interrupted. The armature ring 57 is now moved back into the rest position by the springs 60, in which position its toothed rim 62 is no longer in engagement with the toothed rim 66 of the magnetic body portion 63.

The breechblock 4, 5 which moves forwardly under the pressure of the spring 6 from the shock-absorber 7 is caught by the catch hook 19 and retained in the hooked or engaged position (FIG. 1). The entrainment member 12 is again moved forwardly away from the breechblock support 4 by the action of the spring 14 until impacting against the wall 10 of the breechblock housing 2, and the chain 15 is entrained and such runs over the sprocket wheel or gear 16. In the same manner the cocking operation for the breechblock 4, 5 is interrupted when during its rearward movement a large movement resistance engages thereat.

While there is shown and described present preferred embodiments of the invention, it is to be distinctly understood that the invention is not limited thereto, but may be otherwise variously embodied and practiced within the scope of the following claims. Accordingly,

What is claimed is:

1. An apparatus for cocking a breechblock of an automatic firing weapon comprising, in combination:

A. an electric motor;

B. a displacement mechanism for the breechblock for moving the breechblock into its cocked position;

C. an electromagnetic coupling for connecting said electric motor with said displacement mechanism;

D. transmission means arranged between the electric motor and the electromagnetic coupling;

a. said transmission means forming an overload device including:

1. a worm;

2. a worm gear meshing with said worm;

3. a spring cooperating with said worm;

E. means for mounting said worm to be axially displaceable against the force of said spring;

F. a conical portion provided for the worm;

G. an electric switch for disconnecting the electromagnetic coupling when the breechblock reaches its cocked position;

H. said conical portion actuating said electric switch during axial displacement of the worm for disconnecting the electromagnetic coupling upon encountering a displacement resistance of the breechblock which exceeds a predetermined value.

2. The apparatus as defined in claim 1, wherein the spring is constructed as plate spring means.

* * * * *